United States Patent [19]

Lowell et al.

[11] 4,384,192

[45] May 17, 1983

[54] ELECTRIC HEATING ELEMENT

[75] Inventors: Herman H. Lowell, P.O. Box 3128, Silver Spring, Md. 20901; James E. Philpot, Cookeville, Tenn.

[73] Assignee: Teledyne Still-Man Manufacturing, Cookeville, Tenn. ; by said James E. Philpot

[21] Appl. No.: 239,533

[22] Filed: Mar. 2, 1981

[51] Int. Cl.[3] ..... H05B 3/00

[52] U.S. Cl. ..... 219/468; 219/553; 338/217

[58] Field of Search ..... 219/464, 468, 465, 543, 219/552, 553; 338/138, 142, 195, 217, 215, 218, 308, 326; 427/102, 250, 287; 428/156, 157, 170

[56] References Cited

U.S. PATENT DOCUMENTS

| | | | |
|---|---|---|---|
| 563,032 | 6/1896 | Hadaway, Jr. | 338/218 X |
| 2,700,719 | 1/1955 | Coler et al. | 338/308 X |
| 2,701,296 | 2/1955 | Crawford | 338/217 X |
| 3,095,492 | 6/1963 | Gaiennie | 338/217 X |
| 3,383,497 | 5/1968 | Harris | 219/553 |
| 3,851,150 | 11/1974 | Von Holzen | 219/553 |
| 4,099,071 | 6/1978 | Thornburg | 338/217 |
| 4,233,497 | 11/1980 | Lowell | 219/468 |

*Primary Examiner*—Volodymyr Y. Mayewsky
*Attorney, Agent, or Firm*—Dennison, Meserole, Pollack & Scheiner

[57] ABSTRACT

An electric heating element for a cooking apparatus or other device requiring uniform heat generation over an extended area is presented in which the resistivity ($\rho$), the angular coverage ($\theta$), and/or the thickness (T) of the electrically resistive material at any radial distance (r) from the center of the heating element, are in accordance with the relationship $\rho/\theta T$ is proportional to $r^2$. The variables $\theta$ and $\rho$ may be varied singly, together, or in combination with variation in thickness (T). Heating elements fabricated with cross-sectional shapes calculated in accordance with the relationship set forth above, and disclosed in detail herein, and in which the current flow is radial, provide uniform energy release and therefore nearly uniform temperature across the surface of the element. The absolute element dimensions and masses per unit surface area are small, thereby maximizing rates of desired temperature setting changes. The basic principle is applicable to various technologies related to cooking, wherein an element producing uniform heat generation may be utilized.

13 Claims, 18 Drawing Figures

ELECTRIC HEATING ELEMENT

This application is related to U.S. patent application Ser. No. 966,214, filed Dec. 4, 1978, now U.S. Pat. No. 4,233,497. This invention is a generalization of the invention presented in the earlier application.

This invention relates to an electrical heating element for an electric stove, hot plate, frying pan or similar electrically heated cooking appliance or other device requiring uniform energy release over an extended area. The basic principle is applicable in several technologies, including vacuum evaporation.

BACKGROUND OF THE INVENTION

Modern technology has produced a wide variety of electrical heating devices for use in cooking appliances. One class of electrical heating device which has been popular since the advent of readily available and economical electrical power has been the resistive electrical heating element.

Resistive electrical heating elements have been fabricated in a plurality of shapes over the years, in an attempt to achieve the ideal heating element, which is an element which will provide a flat surface having a uniform heat characteristic without exhibiting a gradient phenomenon or hot spots. In U.S. Pat. No. 4,233,497 to Herman H. Lowell, there is disclosed a heating element of a generally disc-shaped configuration in which the current flows radially, and wherein uniform heat generation over the surface of a heating element is achieved by providing the heating element with a shape wherein the thickness of the resistive material at a given radius from the center of the element varies inversely with the square of the ratio of the given radius to a reference radius at a reference point within the radial dimensions of the heating element. That is, the heating element is structured according to the equation $$T = \frac{T_a \times r_a^2}{r^2},$$

wherein T is the thickness of the resistive heating element, r is the radius at any point from the center of the element, and $T_a$ and $r_a$ are calculated at a reference point ("a"). The thickness of the electrically resistive heating element increases from the outer edges of the generally disc-shaped element towards the center in inverse proportion to the square of the ratio of the radius at any point to that of the radius at a reference point, the thickness value being varied while other parameters remain constant.

The ideal heating element has been approached by other prior art electrical resistive heating devices, but never actually accomplished in cooking appliances. For example, D. Harris in U.S. Pat. Nos. 3,351,742 and 3,383,497 on "electrical resistance heaters" teaches the concept in a graphite heating element of providing a graded thickness to the element, so that the electrical resistance characteristics of the heater will be uniform and a roughly uniform heat will be produced across the surface of the element. In an attempt to vary the parameters of the heating element, a plurality of holes are drilled through the heating element, to give an approximation of uniform heat distribution. By incorporating a plurality of holes in the heating element of Harris, heat flow variations occur which are experimentally chosen to cause the heating element to approach a constant surface temperature. Hole distribution is wholly empirical, an experimental approximation, and rests on no theoretical basis. Further, the heat transfer characteristics created by the holes drilled in the element result in undesired variations in the surface temperature, and thus the ultimate goal of a uniform temperature surface is approached, but not achieved.

Other U.S. Pat. Nos. 3,969,553 to Kondo et al, 3,870,776 to McMahon, and 3,833,386 to Wood et al show various shaped cermets, and combinations of ceramic bases and metal impregnation. These shaped cermets are without specific disclosure as to use as electrical resistance elements, or more specifically, electrical heating elements. None of these devices control variation of resistivity or angular coverage of the conductive material in combination with ceramic base.

Prior art resistance elements, deposited on the surface of a ceramic base, are shown by Bowman in U.S. Pat. No. 2,778,743 and Steigerwalt et al in U.S. Pat. No. 2,648,804. Conant et al in U.S. Pat. No. 2,698,990 discloses metal ceramics using designated particle sizes and proportions, which may be used as resistance elements. This general category of common resistance elements does not attempt to provide uniform heat distribution, as is desired in an electrical heating element.

The heating element of the present invention may utilize a sheath reinforcement structure to ensure mechanical integrity. Various types of reinforced structures are known, as shown by Brines in U.S. Pat. No. 1,960,328 and Decker in U.S. Pat. No. 4,156,997. The radial-membered structure of Brines is intended to be used in a building. The units of Decker et al are tension-compression equilibrium structures. Neither of these structures is known as an integral part of an electric heating element. The development of the present heating element has resulted in a further structural invention, that being the overcoming of stresses during operation via physical reinforcement of the electric heating element.

OBJECTS OF THE INVENTION

In view of the inability of the prior art electric heating systems to provide a uniformly heated element surface, it is a primary object of the present invention to provide an electrical heating element having a simple yet theoretically correct parameter variation which, with a radial current flow, will result in a basically uniform temperature distribution throughout.

It is accordingly another object of the present invention to provide an electrical heating element of the present invention to provide an electrical heating element which varies in resistivity, singly, or together with angular coverage of the resistive material, or in combination with variation of thickness of the element.

Another object of the present invention is to provide an electrical heating element which is structured to provide predetermined relative heat zones on a cooking surface through precisely calculated deviations from the basic inverse square law relationship. A still further object of the present invention is to provide an electrical heating element having a small dimension normal to the principal plane, and a small mass per unit area in that plane, so as to greatly increase rates of change to desired new temperature settings.

A further object of the present invention is to provide a modular electric heating element which is economical to produce and maintain.

A still further object of the present invention is to provide an electrical heating element having increased energy efficiency. In accordance with this object it is desirable to minimize thermal inertia, maximize percentage of areal coverage, and prevent undesirable heat loss.

The foregoing and other objects of the present invention will become apparent in light of the drawings, specification, and claims contained herein.

SUMMARY OF THE INVENTION

The present invention offers theoretically precise variations in resistivity alone proportional to radius squared ($\rho$ proportional to $r^2$), angular coverage of the resistive material varying alone as the negative square of the radius ($\theta$ proportional to $r^{-2}$), or either of these varying in combination with each other or with variations in thickness such that the relationship $\rho/\theta T$ is proportional to $r^2$ is maintained. Thus, heating elements embodying the present invention may be structured in accordance with particular relationships among the parameters which maintain the overall square law relationship; for example; T is proportional to $1/r^n$ and $\rho$ is proportional to $r^{2-n}$, $\theta$ being held constant, thus giving $\rho/\theta T$ proportional to $r^2$, where n can have any integer or fractional value, or zero. Providing a shaped heating element in accordance with this relationship automatically ensures uniform generation of heat throughout, resulting in temperature uniformity across the surface of the element. The invention further contemplates creating cooking or other element electrodes having various areas or bands with precisely calculated predetermined relative heat zones over an energy-release plane. Any of these configurations may further utilize either continuous or stepped variations in the parameters, the latter case producing discrete heat bands. In another embodiment, the invention may take a hybrid configuration, as for example a disc-shaped heating element with radial current flow according to the present invention, in combination with a conventional spiral outer band.

DETAILED DESCRIPTION

Figure 1A:
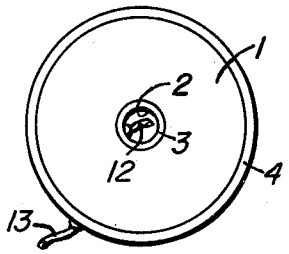
FIG. 1A is an example of a disc-shaped heating element having a continuous heating surface.
Figure 2A:
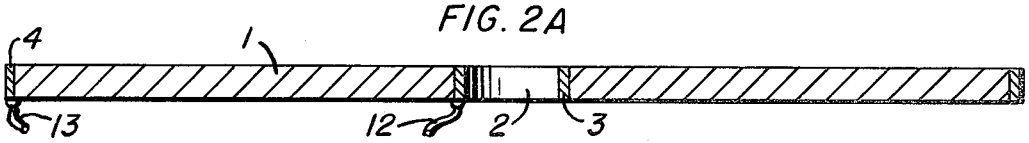
FIG. 2A shows the cross-section of a single layered heating element as shown in FIG. 1A.

Referring now to the drawings in more detail, and first to FIG. 1A thereof, there is shown a disc-shaped heating element having a single continuous surface in accordance with the present invention. The heating element shown in FIG. 1A is a single disc-shaped element of continuous resistive electrical conductor material 1. A center bore 2 is surrounded by inner conductive ring 3, and the outer periphery of the disc is surrounded by outer conductive ring 4. (FIG. 2A shows a cross section of the disc-shaped heating element of FIG. 1A, similar reference numerals indicating similar structures.) Electrical leads 12 and 13 are respectively connected to inner conductive ring 3 and outer conductive ring 4. The body of resistive electrical conductor 1 has a resistivity $\rho$ proportional to the radius squared, angular coverage of the resistive material $\theta$ and thickness T remaining constant. Providing a shaped resistive electrical conductor in accordance with the relationship $\rho/\theta T$ is proportional to $r^2$ automatically provides uniform generation of heat throughout, and substantially uniform temperature across the surface of the element.

Vertical dimensions in all drawings are not necessarily scaled in proportion to one another or to horizontal dimensions.

Figure 1B:
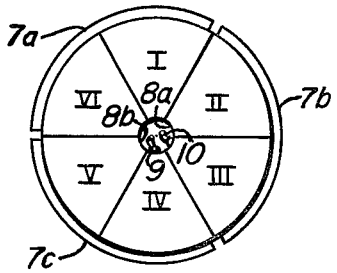
FIG. 1B shows a modified form of the invention wherein the disc-shaped heating element includes six eletrically connected heating element sectors.

The disc-shaped resistive material may further be divided into a plurality of sectors I–VI. These sectors I–VI are actually pie-shaped sections which form a disc-shaped heating element when placed together as shown in FIG. 1B. While six 60° sectors I–VI are illustrated, it will be obvious to one skilled in the art that any number of sectors may be utilized to form a disc-shaped heating element. As shown in FIG. 1B, outer electrical conductors and inner electrical conductors may be used for connecting the individual sectors. Outer electrical conductors *7a*, *7b*, and *7c*, respectively connect heating element sectors I and VI, II and III, and IV and V. Further, inner electrical conductors 8*a* and 8*b* respectively connect sectors I and II, and V and VI. The sectors I–VI are electrically insulated from each other otherwise. Leads 9 and 10 are provided for connection to a suitable power source.

Figure 1C:
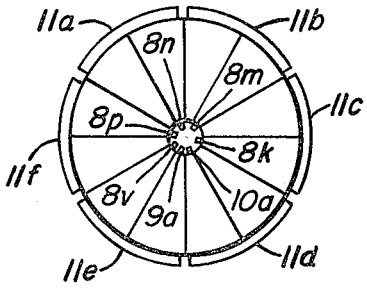
FIG. 1C shows another disc-shaped heating element wherein there are twelve electrically connected 30° heating element sectors.

FIG. 1C shows an alternative embodiment of the invention wherein each of the 60° sectors is split into two 30° sectors by a narrow radial slot or insulator. As before, this maintains the insulation between respective sectors. The six pairs of 30° sectors are connected at the outer periphery by respective conductor strips 11*a*–11*f*, each covering approximately a 60° angle. The twelve sectors may have twelve contact points at the inner periphery for mutual interconnection and for coupling to a source of power similar to FIG. 1B, the pairs of inner contact points may be connected to electrical conductors 8*k*, 8*m*, 8*n*, 8*p*, and 8*v*, and leads 9*a*, and 10*a*.

In all cases, the flow of electricity through the heating element will be radial, between the inner and outer conductors.

As illustrated in FIGS. 1A, 1B, 1C and 2A, the resistive electrical conductor may comprise a single layer of any suitable material. The resistive electrical conductor may simply have varying resistivity and uniform thickness. However, as a further modification, the resistive electrical conductor may be a shaped cermet, wherein resistivity and thickness vary in accordance with the formula $\rho/\theta T$ proportional to $r^2$.

FIG. 2A shows a side view of the heating element 1 of FIG. 1A, which consists of an inner electrical conductive ring 3 about the center bore 2, and an outer conductive ring 4 about the periphery. Leads 12 and 13 couple the respective conductive rings 3 and 4 to a suitable power supply (not shown), producing a radial current flow through the heating element.

There are a variety of ways of fabricating a cermet having a desired resistivity in accordance with the desired square relationship. As an example, a melted metal such as nickel-chrome may be used to impregnate a porous ceramic base (alumina), to achieve a distributed cermet. The distributed cermet may have variable thickness or a tailored distribution, to achieve a graduated transmission characteristic. The variables which may be controlled in order to achieve the desired shaped cermet include: the porosity of the alumina, the thickness of the porous refractory (to achieve a distributed cermet of variable thickness), and variable penetration achieved through one or more techniques including variation of dwell time and a masking technique to achieve a desired pattern of distribution on the surface of or within the porous refractory. The applied conductive material may include a wholly continuous molten metal, or any material having particles of suitable resistivity, such as a resistive ink.

Figure 2B:
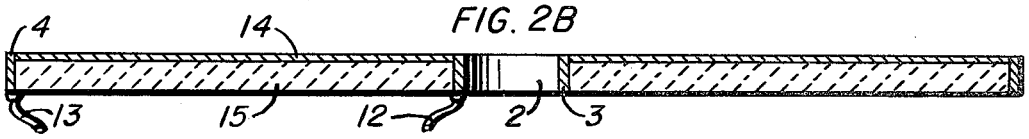
FIG. 2B shows a modified form of the invention wherein a resistive conductor material is deposited on a ceramic base.

The invention will now be discussed in relation to a heating element having a variety of layers of different composition. Referring now to FIG. 2B, there is shown a heating element wherein an electrical resistive material 14 is applied to a ceramic base 15. The ceramic base 15 may be porous or non-porous, or it may have a varying porosity, as desired. If the base is porous, the resistive material may be partially incorporated within the porous ceramic.

Figure 2C:
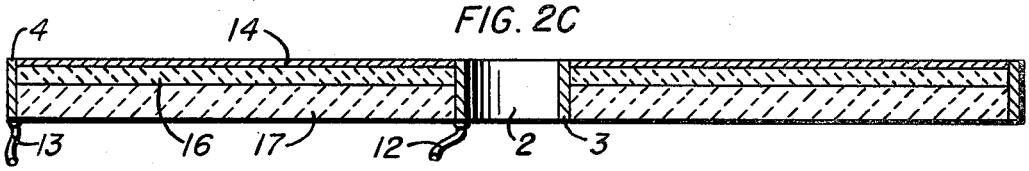
FIG. 2C shows still another modified form of the invention wherein the resistive conductor is deposited in a layer of porous ceramic which is adjacent a non-porous ceramic base.

Referring now to FIG. 2C, there is shown a heating element where the resistive electrical conductor 14 is applied on the surface of a substrate having two layers, 16 and 17. In one example of the embodiment, layer 16 may be a porous ceramic material, while layer 17 may be a non-porous ceramic base. The porous ceramic layer 16 may be alumina having pore sizes from 10 to 80 mils at densities from 2% to 40%. At 2%, pore volume is 98%, and the applied resistive electrical conductor 14 might be wholly continuous. However, at 40% alumina density, the pore volume is 60%, and an applied molten metal may form with substantial discontinuities, achieving a desired very high resistivity. At lower porosities, generally below 50%, there are still discontinuities which can be used to form a highly resistive electrical layer. Again, the resistive material 14 need not be confined to the surface.

Figure 2D:
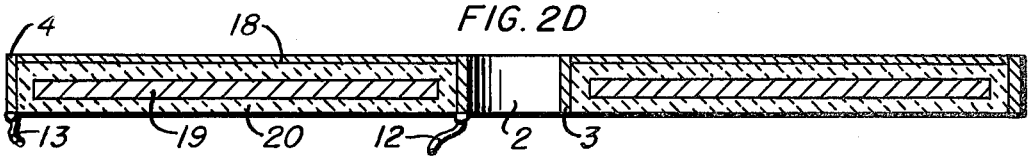
FIG. 2D illustrates another form of the invention using a porcelainized steel substrate.

Another form of the invention is shown in FIG. 2D, wherein the resistive conductor material 18 is applied on porcelainized steel. The inner steel base 19 is, of course, insulated from the electrical resistive material by the thin porcelain coating 20.

Figure 3:
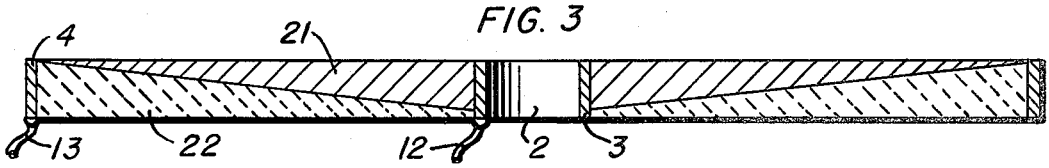
FIG. 3 shows still another modified form of the invention wherein the thickness of the resistive conductor may further be controlled.
Figure 4:
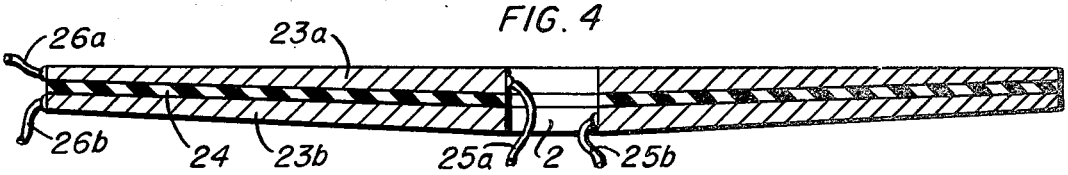
FIG. 4 shows another modified form of the invention wherein two layers of resistive conductor material are separated by an insulating layer, but form a single heating element unit.

Other forms of the invention may use a porous refractory of variable thickness to achieve a distributed cermet of variable thickness. As shown in FIG. 3, the resistive electrical conductor 21 has a varying thickness, which may or may not be linear. The resistive conductor 21 may be a shaped cermet which abuts a complementary ceramic backing layer 22. By controlling the properties of resistivity, thickness, and angular coverage, a shaped heating element having a variety of characteristics may be provided, in accordance with the relationship $\rho/\theta T$ is proportional to $r^2$. Further, the invention is not restricted to a heating element having a single layer of resistive conductive material. FIG. 4 is an example of a heating element in accordance with the invention wherein there are two layers of resistive electrical conductor 23*a* and 23*b*, separated by a layer of insulation 24. Again, the resistive conductor material 23*a* and 23*b* may have any desired cross section. Electrical contacts 25*a*, 25*b*, 26*a* and 26*b* are provided for energization of the heating element layers. As is known from U.S. patent application Ser. No. 966,214, now U.S. Pat. No. 4,233,497, any number of layers, including segmented layers, may be provided for selective activation. Additionally, the layers 23*a* and 23*b* may be interconnected directly around their outer peripheries, rather than by contacts 26*a* and 26*b*.

Figure 5:
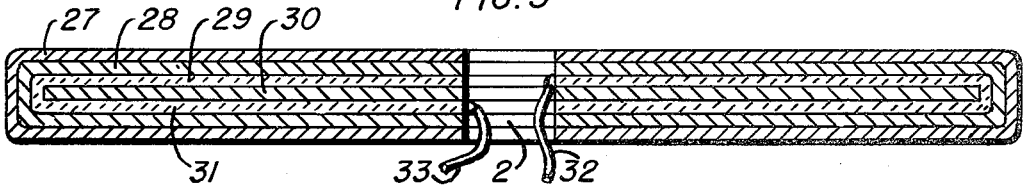
FIG. 5 shows still another form of the invention wherein there are a plurality of layers of insulator, resistive electrical conductor, porous ceramic material, and non-porous ceramic base.

FIG. 5 shows another embodiment of the invention wherein the heating element has a plurality of layers of different compositions. In the example illustrated, the heating element comprises a thin sheath 27 of a durable material such as metal or ceramic, which provides a heating surface resistant to impact and abrasion. Beneath the top sheath 27 is a layer 28 of electrical insulation, if required. The next layer is an upper layer of resistive electrical conductor material 29, applied on the upper surface of non-conducting substrate 30, and a lower layer of resistive electrical conductor material 31 applied on the lower surface of substrate 30. Electrical leads 32 and 33 are respectively coupled to the upper and lower layers of resistive material, 29 and 31. The layers of material which form the heating element are each very thin, providing a compact heating element structure overall.

Figure 6A:
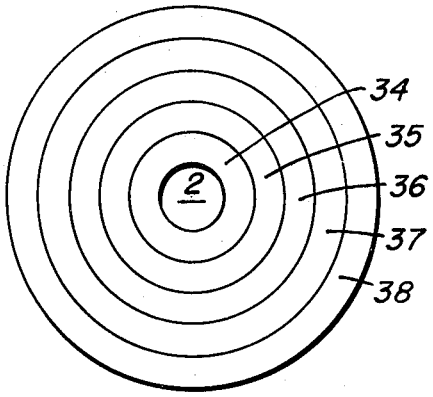
FIG. 6A shows a plan view of a disc-shaped heating element wherein there are a plurality of concentric resistive bands.
Figure 6B:
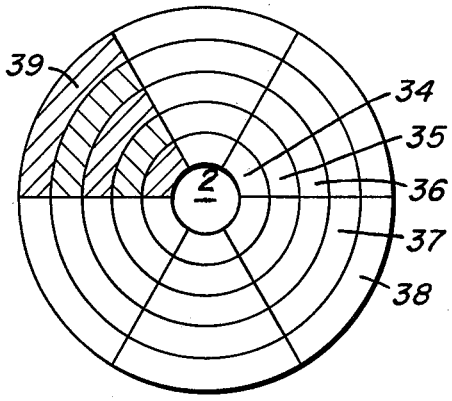
FIG. 6B shows a modification of the heating element of FIG. 6A, wherein there are six 60° sectors.
Figure 6C:
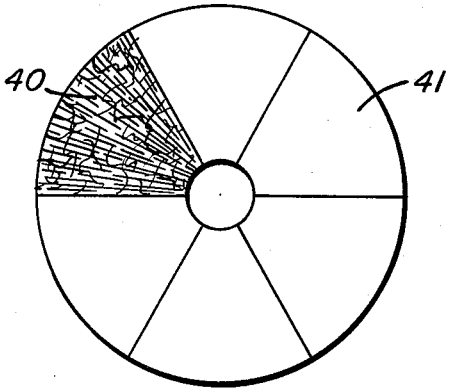
FIG. 6C shows another modified form of the invention wherein the resistive conductor material is applied as a pattern on a substrate material.

FIGS. 6A–6C show other forms of the invention wherein the resistive electrical conductor material is applied in a variety of forms.

With reference to FIGS. 6A and 6B, there is seen a heating element with central bore 2, wherein the resistive electrical conductor material is applied in a plurality of concentric resistive bands 34 through 38. Of course, the number of bands may be selected for any desired application. The heating element of FIG. 6B includes a plurality of sectors, six sectors being representative, as exemplified by sector 39. The sectored heating element of FIG. 6B is otherwise similar to that of FIG. 6A, but allows for modular construction.

As shown in FIG. 6A, a five band heating element consists of a sequence of bands, 34–38. If the bands are geometrically similar, the ratio of the band (radial) width to any one of the three band radii—inner, outer, and arithmetic mean of those—is fixed. It follows that the ratio of two successive corresponding band radii (e.g., the successive arithmetic mean radii) will be fixed for all such successive band pairs of the element.

In particular, if we denote by K, a constant, that common radius ratio, several important properties of the element may then be expressed as functions of the variable K. By definition, if successive radii $r_i$ are numbered from one outward from the innermost band and radius, then the ratio of the outer radius ($r_{i+1}$) to the inner radius ($r_i$) of band i is the same for all bands. [Equation (1)]:

$$r_{i+1}/r_i=K \quad (1)$$

The inner radius of band i is the product of the inner radius of band one and the (i−1)'th power of K. [Equation (2)]:

$$r_i=r_1K^{i-1} \quad (2)$$

The ratio of the radial width, $\Delta r_i$, of the band i, to the inner band radius is (K−1). [Equation (3)]:

$$\Delta r_i=r_i(K-1) \quad (3)$$

The ratio of the radial width of each band to the mean band radius $\overline{r_i}$ [which equals $(r_{i+1}+r_i)/2$] is the constant 2(K−1)/(K+1). [Equation (4)]:

$$\Delta r_i=\overline{r_i}[2(K-1)/(K+1)] \quad (4)$$

The band width is expressed as a function of either the inner radius of band i [Eq. (3)] or the inner radius of the innermost band, band one. [Equation (5)]:

$$\Delta r_1=r_1(K-1)K^{i-1} \quad (5)$$

As a specific example of the design of a simple, 6" overall o.d. element intended for use at 240 V, the following table lists the principal parameters of a five band unit for which K=1.2857, and of which the bands have different, but uniform, resistivities.

TABLE I

| Band | Inner Radius | Outer Radius | Radial Width | Mean Radius | Resistivity (Ω/□) | Radial Res. (Ω) | Area (Sq.") | Power (Watts) |
|---|---|---|---|---|---|---|---|---|
| 1 | 0.760 | 0.977 | 0.217 | 0.869 | 81 | 3.22 | 1.185 | 59 |
| 2 | 0.977 | 1.256 | 0.279 | 1.117 | 134 | 5.33 | 1.959 | 98 |
| 3 | 1.256 | 1.615 | 0.359 | 1.436 | 221 | 8.81 | 3.238 | 162 |
| 4 | 1.615 | 2.077 | 0.462 | 1.846 | 366 | 14.56 | 5.353 | 268 |
| 5 | 2.077 | 2.670 | 0.593 | 2.373 | 605 | 24.06 | 8.847 | 442 |
| | (Dimensions in inches) | | | | TOTALS | 56.00 | 20.6 | 1029 |

In this unit, the common ratio of band width to mean band radius is 0.250 (from Equation 4).

Further, in this design, the resistivity of each band is uniform, and band thickness is fixed at about 0.5 mil. These design characteristics require a stepped, common resistivity ratio of $(\overline{r}_{i+1}/\overline{r}_i)^2=K^2=1.653$.

The resistivities need not have been assigned the values in Table 1. If, for example, the respective band resistivities has been assigned successive values proportional to the successive mean band radii, the successive band thicknesses would have had to be reduced in inverse proportion to the increasing radii, to maintain, with the varying resistivities, the required radial consistency of conversion of electrical into thermal energy. Alternatively, if thickness were maintained at a fixed value, the angular coverage, $\theta$, of each band could have been altered by, for example, cutting a series of fine radial slots of predetermined circumferential width and distribution to produce bands having the desired overall characteristic $\rho/\theta T \sim r^2$.

In accordance with this concept, FIG. 6C shows by way of example resistive conductor material 40 applied as a pattern on a substrate material 41, to vary angular coverage $\theta$. This pattern of resistive material 40 is only representative.

Figure 7:
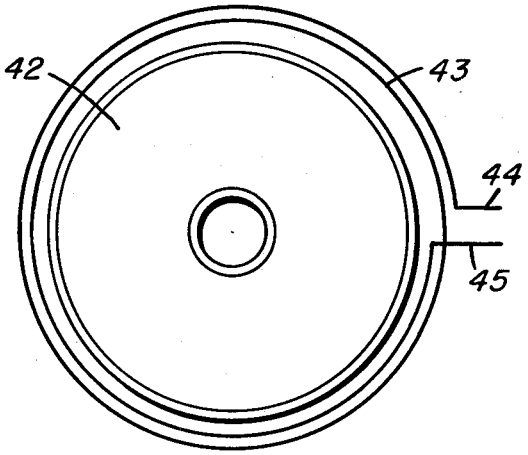
FIG. 7 shows a disc-shaped heating element according to the invention in combination with an outer spiral shaped heating element structure.

It should further be understood that the generally disc-shaped heating element of the present invention may be utilized in combination with other forms of heating elements. As an example thereof, FIG. 7 shows a disc-shaped heating element 42 in combination with an outer spiral-shaped heating element structure 43, having conductive leads 44 and 45.

Figure 8:
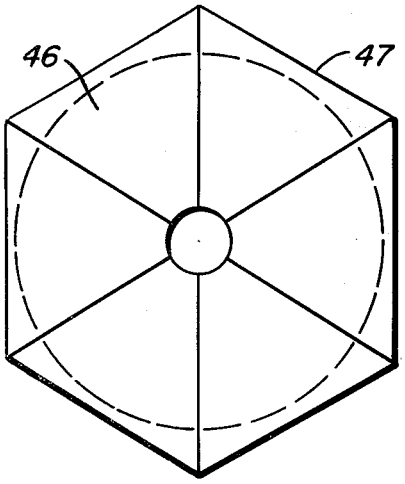
FIG. 8 shows a web-like reinforcing structure for reinforcing the disc-shaped heating element.
Figure 9:
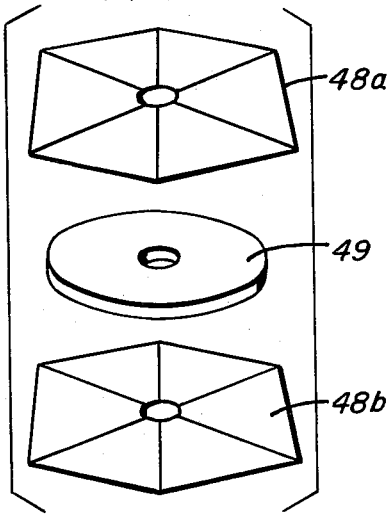
FIG. 9 shows an exploded view of a pair of web-like reinforcing structures in a sandwich arrangement with a heating element according to the invention.

FIG. 8 shows the further development of a disc-shaped heating element 46 having a reinforcing sheath 47 which resists certain stresses during operation of the heating element. The application of such a reinforcing structure is more clearly seen from FIG. 9 which shows an exploded view of a pair of reinforcing structures 48*a* and 48*b* which are used in a sandwich arrangement with a generally flat disc-shaped heating element 49. The reinforcing members 48*a* and 48*b* have sectors under tensile stress in a direction normal to the medial radius of the sector, to provide a high resistance to deflection or damage caused by forces in a direction normal to the principal plane of the element. The reinforcing members 48*a* and 48*b* may be attached about their periphery, and the combined sandwich arrangement will tend to mechanically isolate the heating element structure 49 from the operating environment.

The sheath reinforcing members may be of generally web-like configuration, or may include partially corrugated reinforcement structure. The design criteria to be observed include: (A) the provision of a continuous upper surface on the upper reinforcing member for a usable, flat surface, and (B) the provision of suitably designed reinforcement structure to bear the tangential stresses.

Figure 10:
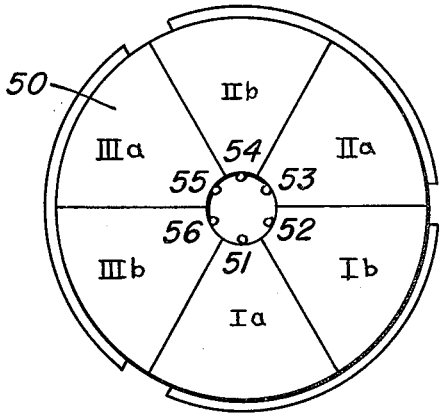
FIG. 10 shows a six-sectored heating element having a plurality of contact points for selective activation of the sectors.
Figure 11:
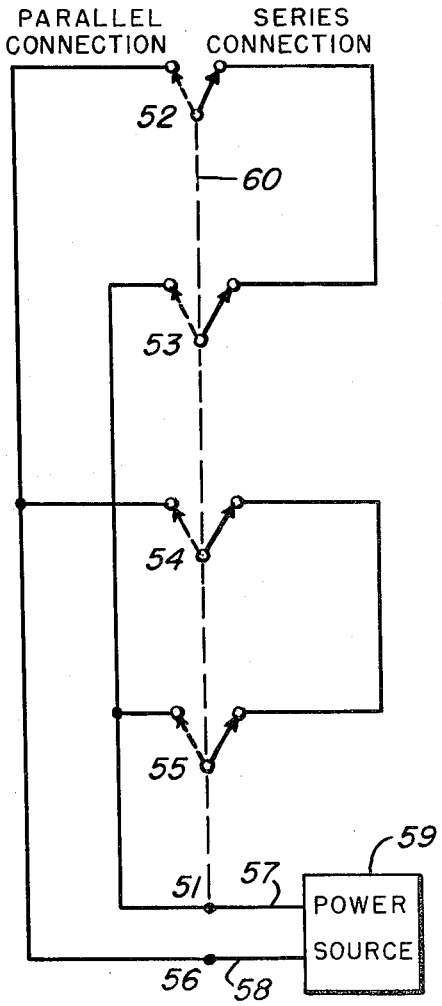
FIG. 11 shows a two-power level four-gang switching circuit for selective activation of the heating element sectors as shown in FIG. 10.

Turning now to FIGS. 10 and 11, the selective electrical activation of a heating element as disclosed will be described. More specifically, FIG. 10 shows a six-sectored heating element 50 having a plurality of contact points 51–56 for selectively activating the individual sectors in various ways. Sector Ia has contact 51; sector Ib has contact 52; contact 53 is in sector IIa; contact 54 is in sector IIb; contact 55 is in sector IIIa; and sector IIIb has contact 56. These contact points 51–56 are coupled to a switching arrangement as shown in FIG. 11.

In FIG. 11, a two-power level, four-gang switching arrangement is shown. Contact points 51 and 56 are fix-coupled to power supply leads 57 and 58 respectively, from power source 59. The switch 60 has two positions, one for parallel connection and the other for series connection of the heating element sectors. In the parallel connection, contact points 51, 53 and 55 are connected to power supply lead 57, and contact points 52, 54, and 56 are coupled to power supply lead 58. When the switch is used to select the series connection, the contact points connect the sectors in series.

Various power levels may be selected by simple switching arrangements. If the pairs of cross-connected sectors Ia and Ib, IIa and IIb, and IIIa and IIIb are connected as shown in FIG. 10, and each sector has a resistance of 72 ohms, then each pair of sectors in series will have a resistance of 144 ohms. The resistance of the three pairs of connected sectors, connected in series, is 432 ohms. The resistance of the three pairs of connected sectors, connected in parallel, is 48 ohms. Therefore, at 240 volts, the power for the series connection is 133 watts, while the power for the parallel switch connection is 1200 watts. Thus, by simply switching between series and parallel configurations, the power level may be varied between normal (1200 watts) and one-ninth that normal power. By using a more elaborate switching arrangement, based on connections to a generally even number of smaller-angle electrically independent sectors, a greater number of power levels can be achieved. Also, individual sectors may be at times left not powered.

In another arrangement, six 60° sectors, for example, may each be divided into half-sectors, allowing some six to eight different power levels to be achieved through simple switching, covering a power range of thirty-six to one.

We claim:

1. An electric heating element in which the current flow is generally radial, comprising: a resistive electrical conductor configured about a central point and having a varying resistivity; said electrical conductor including radial dimensions in a first plane including said central point, and having a constant thickness perpendicular to said first plane; and wherein the resistivity of said conductor at a given radius from said central point varies with the square of the given radius to provide uniform heat distribution across the surface of the heating element.

2. An electric heating element as claimed in claim 1 wherein said resistive electrical conductor comprises concentric bands, the mean resistivity of each respective band being proportional to the square of the mean radius in each respective band.

3. An electrical heating element in which the current flow is generally radial, comprising: a resistive electrical conductor configured about a central point; said electrical conductor including radial dimensions in a first plane including said central point, and having a constant thickness perpendicular to said first plane; and wherein the angular coverage of the resistive electrical conductor at a given radius from said central point varies inversely with the square of the given radius to provide uniform heat distribution across the surface of the heating element.

4. An electric heating element in which the current flow is generally radial, comprising: a resistive electrical conductor configured about a central point and having a varying resistivity; said conductor including radial dimensions in a first plane including said central point, and having a constant thickness perpendicular to said first plane; and wherein said resistivity of said electrical conductor at a given radius from said central point varies with the (2—n)th power of the given radius, and the angular coverage of the resistive electrical conductor at said given radius varies inversely with the n'$^{th}$ power of the given radius to provide uniform heat distribution across the surface of the heating element.

5. An electric heating element as claimed in claim 3, or 4, wherein the angular coverage is determined by the pattern of application of said resistive electrical conductor to a substrate.

6. An electric heating element as claimed in claim 5, said substrate further comprising a porous material, and wherein said resistive electrical conductor is applied at least partially within said porous material.

7. An electric heating element as claimed in claim 5 wherein said pattern of resistive electrical conductor on or within said substrate comprises a plurality of successively branching paths.

8. An electric heating element as claimed in any of claims 1, 3, or 4, wherein said resistive electrical conductor is formed from a flowable material, said flowable material being deposited on a substantially electrically non-conductive substrate.

9. An electric heating element as claimed in claim 8, wherein said substrate comprises porcelainized steel.

10. An electric heating element as claimed in claim 8, wherein said substrate has pores, and said resistive electrical conductor material enters said pores to mate with said substrate.

11. An electric heating element as claimed in claim 10 wherein said substrate comprises a ceramic material.

12. An electric heating element as claimed in claim 11, further comprising a relatively non-porous backing layer adjacent said porous substrate.

13. An electric heating element as claimed in claim 12 wherein said backing layer comprises a ceramic material.

* * * * *